US005135211A

United States Patent [19]

Barnebey

[11] Patent Number: 5,135,211

[45] Date of Patent: Aug. 4, 1992

[54] REJECT CONTROL SYSTEM IN A COLLATOR HAVING FEED AND MISFEED ASSOCIATED BITS IN AN INCREMENTAL SHIFT REGISTER

[75] Inventor: Michael D. Barnebey, Dayton, Ohio

[73] Assignee: AM International Incorporated, Chicago, Ill.

[21] Appl. No.: 767,989

[22] Filed: Sep. 30, 1991

[51] Int. Cl.[5] ..... B65H 39/02

[52] U.S. Cl. ..... 270/54

[58] Field of Search ..... 270/54, 55, 56, 57, 270/58

[56] References Cited

U.S. PATENT DOCUMENTS

| | | | |
|---|---|---|---|
| 3,519,264 | 7/1970 | Beacham et al. | 270/54 X |
| 3,525,516 | 8/1970 | Bushnell et al. | 270/54 X |
| 3,561,752 | 2/1971 | McCain | 270/54 X |
| 3,578,310 | 5/1971 | Carson, Jr. | 270/54 |
| 3,819,173 | 6/1974 | Anderson et al. | 2770/58 X |
| 3,902,708 | 9/1975 | Wise et al. | 270/58 |
| 3,924,846 | 12/1975 | Reed | 270/56 |
| 4,022,455 | 5/1977 | Newsome et al. | 270/54 |
| 5,031,891 | 7/1991 | Kobler et al. | 270/54 |

*Primary Examiner*—Edward K. Look
*Assistant Examiner*—John Ryznic
*Attorney, Agent, or Firm*—Tarolli, Sundheim & Covell

[57] ABSTRACT

A reject control system is used in a collator having a plurality of hoppers for feeding a plurality of signatures to collating spaces along a collating conveyor movable past the hoppers. Each collating space is divided into a plurality of segments in which at least one segment is associated with a dead zone of the collating space. A shift register has a plurality of adjacent bits. Each bit is associated with a segment of a particular collating space. The setting of a bit associated with a segment other than a segment corresponding to the dead zone of a collating space is indicative of a misfeed condition in the collating space. Information is shifted between adjacent bits in the incremental shift register during operation of the collator.

5 Claims, 1 Drawing Sheet

REJECT CONTROL SYSTEM IN A COLLATOR HAVING FEED AND MISFEED ASSOCIATED BITS IN AN INCREMENTAL SHIFT REGISTER

BACKGROUND OF THE INVENTION

1. Technical Field

The present invention relates to a gathering line and is particularly directed to a reject control system for use along a gathering line.

2. Background Art

A gathering line includes a plurality of hoppers and a gatherer chain defining a plurality of chainspaces. Each chainspace corresponds to one collating space along the gathering line. Each collating space moves downstream and passes the hoppers in turn to receive a signature from each of the hoppers to form a collated assembly of signatures in the collating space. A feeding mechanism is associated with each hopper for feeding a signature from the hopper to a collating space. The feeding mechanism associated with each hopper is operated so that a signature is transferred at the proper time from the hopper to a collating space.

A reject control system is associated with the gathering line. The reject control system typically includes a shift register having a plurality of adjacent bits as is known. At any given moment, each bit contains information indicative of the condition of one collating space along the gatherer chain. The particular collating space with which the information contained in a particular bit is associated depends upon the position of the collating spaces relative to the hoppers. The information contained in the particular bit is shifted to a "downstream" bit as is known when the collating spaces move downstream relative to the hoppers. A controller scans the information contained in each of the plurality of bits to control operation of the gathering line.

If a misfeed condition occurs at a particular hopper and a particular collating space, the bit associated with the particular collating space at that moment is set. When the controller scans the bits of the shift register and detects that the bit associated with the particular collating space is set, the feeding mechanisms of all hoppers located downstream from the particular hopper at which the misfeed condition occurred will not later feed any signatures to the particular collating space. A reject mechanism located at the end of the gathering line may be used to reject the collated assembly of signatures in the particular collating space at which the misfeed condition occurred.

A disadvantage of using a shift register in which each bit contains information indicative of the condition of one collating space at a given moment is that, when a misfeed condition occurs at a particular hopper and a particular collating space, the setting of the associated bit at that moment must be exactly timed. The setting of the associated bit must be exactly timed so that the correct bit is set and not a bit located adjacent the correct bit. The setting of the correct bit in the event of a misfeed condition at a particular hopper and a particular collating space is made even more difficult when timing of the feeding mechanism associated with the particular hopper is routinely changed.

SUMMARY OF THE INVENTION

In accordance with the present invention, a reject control system is provided for use in a collator having a plurality of hoppers for feeding a plurality of signatures to collating spaces along a collating conveyor movable past the hoppers. Each collating space is divided into a plurality of segments in which at least one segment is associated with a dead zone of the collating space. The reject control system comprises a shift register having a plurality of adjacent bits. Each bit is associated with a segment of a particular collating space. The setting of a bit associated with a segment other than a segment corresponding to the dead zone is indicative of a misfeed condition in the particular collating space. Means is provided for shifting information between adjacent bits in the incremental shift register during operation of the collator.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF PREFERRED EMBODIMENT

Figure 1:
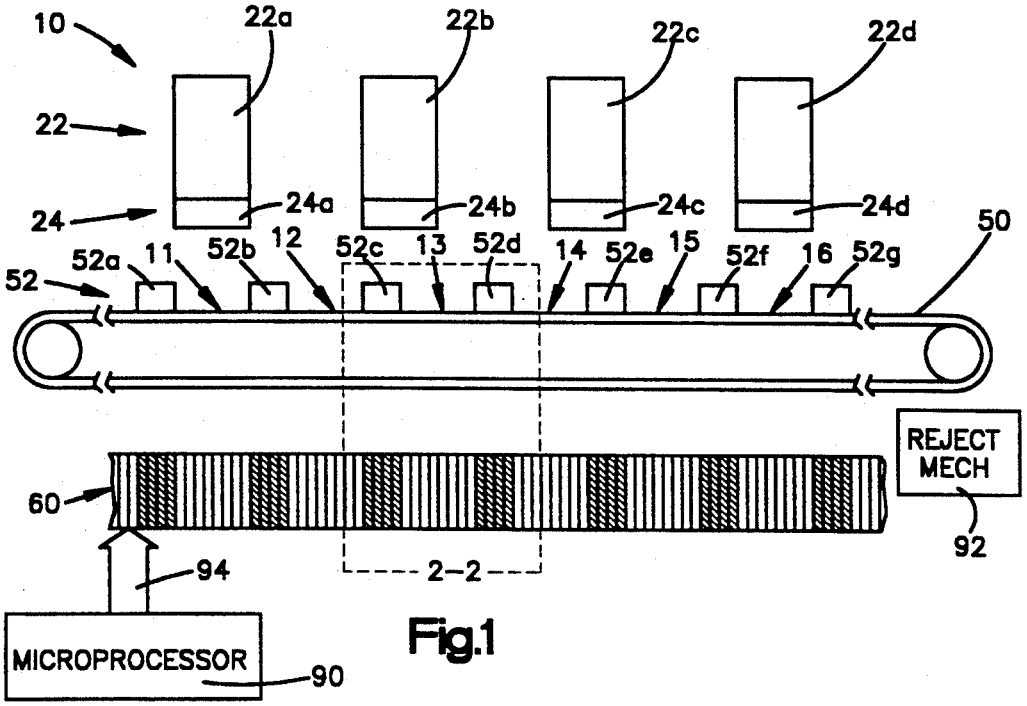
FIG. 1 is a schematic block view of a gathering line incorporating a reject control system constructed in accordance with the present invention.

A collator 10 having a plurality of hoppers 22 is schematically illustrated in FIG. 1. It is to be understood that there can be any number of hoppers. However, for purposes of explanation only, four hoppers designated individually as 22*a*, 22*b*, 22*c*, 22*d* are illustrated. A plurality of feeders 24 are designated individually as 24*a*, 24*b*, 24*c*, 24*d*. Each of the feeders 24 is associated with the correspondingly lettered hopper.

The collator 10 further includes a collating conveyor 50 movable beneath the hoppers 22. A plurality of conveyor pins 52 are disposed along the collating conveyor 50 to define spaces between adjacent conveyor pins 52 for receiving signatures from the hoppers 22 to form collating assemblies of signatures. The seven conveyor pins 52 are designated individually as 52*a*, 52*b*, 52*c*, 52*d*, 52*e*, 52*f*, 52*g*. As illustrated in FIG. 1, the seven conveyor pins 52 define six collating spaces designated individually as 11, 12, 13, 14, 15, 16. Each of the collating spaces 11–16 has one of the conveyor pins 52 located in the collating space. A reject mechanism 92 is located at the downstream end of the collating conveyor 50. Each of the collating spaces 11–16 is movable past the hoppers 22 in turn to receive a signature from each of the hoppers 22.

An incremental shift register 60 is associated with the hoppers 22. The shift register 60 has a plurality of adjacent bits associated therewith. A controller 90 such as a microprocessor scans the bits of the incremental shift register 60. Microprocessors are readily available in the commercial market. Their internal structure and operation are well known in the art and, therefore, the microprocessor 90 will not be described in detail herein. The microprocessor 90 also provides a master sync control signal on control line 94 for indexing the incremental shift register 60.

Each of the collating spaces 11–16 is divided into a plurality of segments in which at least one segment is associated with a dead zone of the collating space. The dead zone of a collating space is that region of the collating space in which it is undesirable to drop a signature because a jam on the collating conveyor 50 would be a certainty if a signature was to be dropped in this region. Each bit of the incremental shift register 60 is associated with a segment of a particular collating space.

Figure 2:
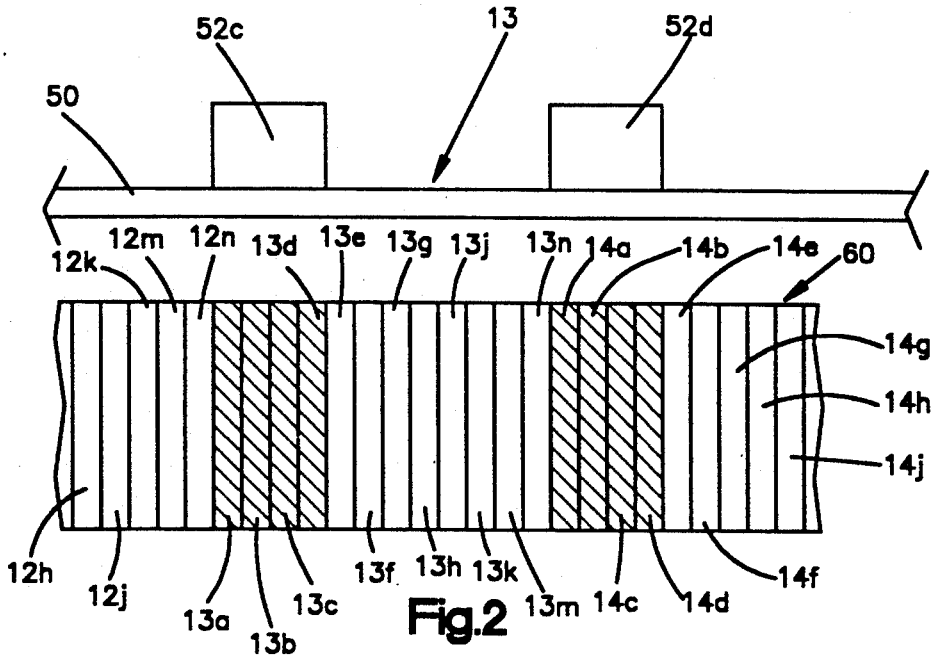
FIG. 2 is an enlargement of a portion, taken approximately around line 2—2, of the schematic block view of FIG. 1.

The dead zone of a collating space and the bits associated with the segments of the collating space are described in more detail hereinbelow. Since each collating space is identical, only the collating space 13 and the bits associated with the segments of the collating space 13 are described in detail. The collating space 13 shown in FIG. 2 is divided into twelve segments in which four of the twelve segments correspond to the dead zone of the collating space 13. The twelve bits associated with the collating space 13 are designated individually as 13*a*, 13*b*, 13*c*, 13*d*, 13*e*, 13*f*, 13*g*, 13*h*, 13*j*, 13*k*, 13*m*, 13*n*. The four bits 13*a*, 13*b*, 13*c*, 13*d* correspond to the dead zone which, in turn correspond to the presence of the conveyor pin 52*c*. The remaining eight bits, i.e., 13*e*, 13*f*, 13*g*, 13*h*, 13*j*, 13*k*, 13*m*, 13*n*, associated with the collating space 13 are each associated with a segment other than corresponding to the dead zone of the collating space 13.

During operation of the collator 10, the collating conveyor 50 moves beneath the hoppers 22 and each of the collating spaces 11–16 moves past the hoppers 22 in turn to receive a signature from each of the hoppers 22. As the collating spaces 11–16 receive signatures from the hoppers 22, a collated assembly of signatures is formed in each collating space. As the collating spaces 11–16 move past the hoppers 22 and receive signatures from the hoppers 22, the microprocessor 90 provides the master sync control signal on control line 94 to index the incremental shift register 60 and thereby shift information contained in the bits of the incremental shift register 60 as is known. The shifting of information in the bits of the incremental shift register 60 is synchronized to downstream movement of the collating spaces 11–16 past the hoppers 22.

If a misfeed condition occurs at a particular hopper and a particular collating space, then a bit is set. The particular bit set is associated with a segment other than a segment corresponding to the dead zone of the particular collating space. For example, if a misfeed condition occurs at the hopper 22*b* and the collating space 13, then one of the eight bits 13*e*, 13*f*, 13*g*, 13*h*, 13*j*, 13*k*, 13*m*, 13*n* is set. When the microprocessor 90 scans the bits of the incremental shift register 60 and detects that one of the eight bits 13*e*, 13*f*, 13*g*, 13*h*, 13*j*, 13*k*, 13*m*, 13*n* associated with the collating space 13 is set, the microprocessor 90 provides a signal to inhibit the feeding mechanisms of all hoppers located downstream from the hopper 22*b* so that the downstream hoppers will not later feed any signatures to the collating space 13. Thus, the setting of a bit associated with a segment other than a segment corresponding to the dead zone of the collating space 13 is indicative of a misfeed condition in the collating space 13.

Although the incremental shift register 60 described hereinabove provides twelve bits for each collating space, it is contemplated another number of bits may be associated with each collating space so long as at least one bit is associated with the dead zone of the collating space and at least one bit is associated with other than the dead zone of the collating space.

An advantage is achieved by providing an incremental shift register having at least one bit associated with a dead zone of each collating space and at least one bit associated with other than the dead zone of the collating space. The advantage is achieved because of the presence of the dead zones associated with the collating spaces. The advantage is that proper operation and timing of the collator 10 are maintained without requiring any reconfiguration of software associated with the microprocessor 90 even when phasing of a hopper relative to movement of the collating conveyor 50 has been changed. When phasing of a hopper relative to movement of the collating conveyor 50 is changed, phasing differences occur between indexing of the incremental shift register 60 and a misfeed condition of the hopper. By using the incremental shift register 60 in the manner as just described, phasing differences occurring between indexing of the incremental shift register 60 and a misfeed condition of a hopper are accommodated and proper operation and timing of the collator 10 are thereby maintained without requiring any reconfiguration of software associated with the microprocessor 90.

From the above description of the invention, those skilled in the art will perceive improvements, changes and modifications. Such improvements, changes and modifications within the skill of the art are intended to be covered by the appended claims.

Having described the invention, the following is claimed:

1. A reject control register for use in a collator having a plurality of hoppers for feeding a plurality of signatures to collating spaces along a collating conveyor movable past the hoppers, each collating space being divided into a plurality of segments in which at least one segment corresponds to a dead zone of the collating space, said reject control system comprising:

a shift register having a plurality of adjacent bits, each bit being associated with a segment of a particular collating space, the setting of a bit associated with a segment other than a segment corresponding to the dead zone being indicative of a misfeed condition in the particular collating space; and means for shifting information between adjacent bits in said incremental shift register during operation of the collator.

2. The reject control system of claim 1 wherein each collating space has twelve bits associated therewith at a given moment in time.

3. The reject control system of claim 2 wherein four of the twelve bits associated with each collating space correspond to the dead zone of the collating space.

4. The reject control system of claim 1 wherein said means for shifting information provides a master sync control signal for shifting the bits in said incremental shift register.

5. The reject control system of claim 1 wherein at least one bit is associated with the dead zone of each collating space and at least one bit is associated with other that the dead zone of the collating space.

* * * * *